United States Patent [19]

Gregg

[11] 4,334,579

[45] Jun. 15, 1982

[54] METHOD FOR GASIFICATION OF DEEP, THIN COAL SEAMS

[75] Inventor: David W. Gregg, Moraga, Calif.

[73] Assignee: The United States of America as represented by the United States Department of Energy, Washington, D.C.

[21] Appl. No.: 182,561

[22] Filed: Aug. 29, 1980

[51] Int. Cl.[3] ..... E21B 43/243; E21B 43/30; E21C 43/00

[52] U.S. Cl. ..... 166/256; 166/50; 166/245

[58] Field of Search ..... 166/256, 259, 245, 280, 166/50

[56] References Cited

U.S. PATENT DOCUMENTS

| | | | |
|---|---|---|---|
| 2,914,309 | 11/1959 | Salomonsson | 166/256 X |
| 2,994,376 | 8/1961 | Crawford et al. | 166/256 X |
| 3,152,638 | 10/1964 | Geffen et al. | 166/256 X |
| 3,563,606 | 2/1971 | Sears | 166/259 X |
| 4,026,356 | 5/1977 | Shuck | 166/259 |
| 4,036,298 | 7/1977 | Kreinin et al. | 166/256 X |
| 4,222,437 | 9/1980 | Sabol | 166/256 X |

OTHER PUBLICATIONS

Thring, "Underground Gasification of Coal", Mining Congress Journal, Sep. 1944, pp. 37, 38 and 52.

Hill, "Permeability Enhancement Methods for Preparing a Coal Bed for in Situ Coal Gasification", UCI-D-18096, Laurence Livermore National Laboratory (1979).

Gregg et al., "Basic Principles of Underground Coal Gasification", UCRL-52107, Lawrence Livermore National Laboratory (1976).

*Primary Examiner*—Stephen J. Novosad

*Attorney, Agent, or Firm*—Henry P. Sartorio; Roger S. Gaither; Richard G. Besha

[57] ABSTRACT

A method of gasification of coal in deep, thin seams by using controlled bending subsidence to confine gas flow to a region close to the unconsumed coal face. The injection point is moved sequentially around the perimeter of a coal removal area from a production well to sweep out the area to cause the controlled bending subsidence. The injection holes are drilled vertically into the coal seam through the overburden or horizontally into the seam from an exposed coal face. The method is particularly applicable to deep, thin seams found in the eastern United States and at abandoned strip mines where thin seams were surface mined into a hillside or down a modest dip until the overburden became too thick for further mining.

8 Claims, 4 Drawing Figures

METHOD FOR GASIFICATION OF DEEP, THIN COAL SEAMS

The U.S. Government has rights in this invention pursuant to Contract W-7405-ENG-48 between the U.S. Department of Energy and the University of California (41 CFR 9-9.109-6(i)(5)(ii)(B)).

BACKGROUND OF THE INVENTION

The invention relates to underground coal gasification and more particularly to an in situ method for the gasification of deep, thin coal seams.

The United States and the world are facing a severe energy crisis, caused largely by the shortage and political instability of the world petroleum supply. Coal is the most abundant fossil fuel in the United States, with sufficient reserves to last for hundreds of years. About 400 billion tons can be easily mined; an estimated 6.4 trillion tons lie too deep to mine economically. Coal seams near the surface are generally recovered by strip mining. However, while the coal is abundant, the use of coal as fuel presents serious environmental problems.

Coal gasification methods have been used to produce combustible fuel from coal. When coal is heated in the presence of oxygen and steam it gives off a mixture of combustible gases which can be refined and purified and used as fuel. These product gases are environmentally more advantageous than coal since they burn cleaner, producing less air pollution and are easier to transport. Above-ground gasification processes are available but still require expensive and difficult mining and transportation before surface processing.

It is more advantageous to gasify coal in situ by chemically reacting the coal underground to produce combustible product gases. An oxidizing gas and steam are pumped down through an injecting well and the coal is ignited. The product gases are removed through a production or recovery well. For the process to occur, a permeable path through the coal must be provided between the injection and production well to permit the high volume gas flow that is required.

The most viable linking methods include countercurrent or reverse combustion, directional drilling, and electrolinking. Countercurrent or reverse combustion linking is the most commonly used technique for enhancing the permeability of a coal bed. Air is forced into the injection well and flows to the production well through natural fissures in the coal bed. The coal at the bottom of the production well is ignited and a burn front is drawn by conduction toward the source of oxygen, charring a narrow channel countercurrent to the flow of air. The directional drilling method produces a gasification channel in the coal by drilling along a coal steam at varying angles and intersecting the production and injection wells. The electrolinking method utilizes an electric current to char a channel of coal between two access holes.

Most of the coal in the western United States is found in thick seams for which the reverse combustion and directional drilling methods of linking are more reliable and more economical. A link is established at the bottom of the thick coal seam so that as the gasification process progresses coal falls into the void, producing coal rubble with a large surface area for coal-gas reactions. It is estimated that 1.8 trillion tons of coal can be reached by conventional underground coal gasification technology. This represents a tremendous resource that cannot generally be reached by mining.

However most of the coal in the eastern United States is located in deep, thin seams for which the conventional in situ coal-rubblization process for achieving intimate contact between the gases and coal in order to produce high quality, stable composition gas cannot be utilized. The seams are not thick enough to produce significant amounts of falling coal and eastern bituminous or swelling coals do not flake and fall like western lignite and subbituminous or shrinking coals. An additional coal resource that has not been utilized is the coal reserves left at abandoned strip mines, particularly in the eastern and southwestern United States. At numerous abandoned strip mines relatively thin coal seams were surface mined into a hillside or down a modest dip until the overburden became so thick that further mining was not economical. Often the mines were not backfilled so the coal face remains exposed over long distances. Sometimes the coal was mined a few hundred feet further into the seam by using augers.

It is an object of the invention to provide a method for the gasification of deep, thin coal seams.

It is another object of the invention to provide a method to gasify coal seams in abandoned strip mines from the exposed coal faces.

It is also an object of the invention to provide a method for achieving intimate contact between gases and coal in a thin seam during an in situ gasification process.

SUMMARY OF THE INVENTION

The invention is a method for gasification of deep, thin coal seams using bending subsidence, a form of roof collapse, to confine gas flow against the coal. A series of vertical holes are drilled into the coal seam around the perimeter of the coal removal area, forming at least one production well and a series of injection wells. The wells are sequentially linked by the electrolinking process or an alternate process. The gasification process begins by injecting combustion supporting gas into an injection well adjacent to a production well. The injection point is then moved sequentially around the perimeter away from the production well to sweep out the coal removal area. Subsidence is partly controlled by the location of the injection points and is used to confine the gas flow to a region close to the unconsumed coal face.

An alternate embodiment of the invention is directed at the gasification of coal remaining at abandoned strip mines. Linkage paths are established by drilling in from the exposed coal face. Access holes are drilled around the perimeter of the coal removal area into the linkage paths. The gasification process is carried out by sweeping out the coal removal area using bending subsidence to confine the gas flow next to the coal face. Alternate embodiments are implemented entirely or almost entirely from the coal face. The injection point is controlled by a withdrawable or degradable injection pipe and moved gradually toward the coal face to maintain the injection point inside the compression zone created by subsidence.

The foregoing and other aspects of the invention will become apparent from the following detailed description considered in conjunction with the accompanying drawings.

DETAILED DESCRIPTION OF THE PREFERRED EMBODIMENTS

The invention is a method for the gasification of deep, thin coal seams by inducing bending subsidence of the overburden to confine gas flow against unconsumed coal. A basic requirement for underground coal gasification is that intimate contact between the coal and gases must be achieved to obtain a high quality, stable composition product gas. Two types of subsidence can occur—bulking subsidence and bending subsidence. With bulking subsidence the original underground void space remains underground distributed over a larger total volume between fallen chunks of roof thus creating a large permeable zone allowing gas to flow with minimal contact with coal. With bending subsidence the original underground void is displaced to the surface by the overburden bending into the void. Bending subsidence allows subsidence to be used to confine gas flow to a region close to the unconsumed coal face. Bending subsidence occurs if the dimensions of the cavity become so large that a self-sustaining arch in the overburden cannot be maintained. With bending subsidence a zone of compression exists in the subsided overburden immediately inside the edge of the cavity. This zone of compression can have a relatively low permeability and can be used to help confine gas flow close to the coal face where there is a highly permeable zone of tension.

Figure 1:
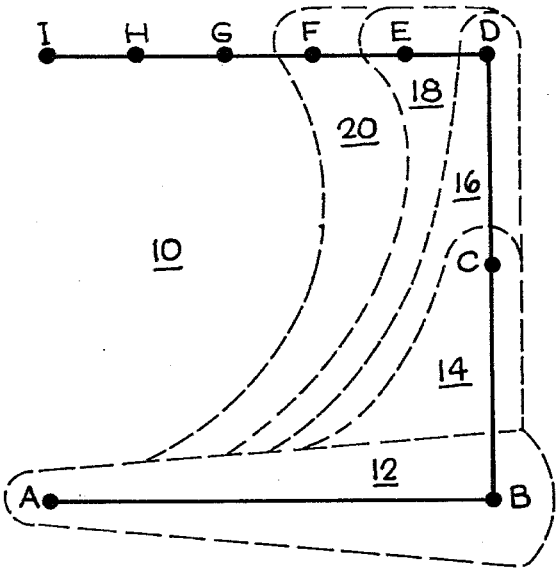
FIG. 1 is a top plan view of a coal seam showing the linkage of vertical holes around the coal removal area and the sweep and subsidence pattern during processing.

A method for the gasification of deep, thin coal seams utilizing controlled bending subsidence to channel gas flow close to the unconsumed coal face is illustrated in FIG. 1. A series of vertical holes A through I are drilled into the coal seam around the perimeter of the coal removal area 10. A U-shaped layout is preferably used with large hole spacings, or large spacings combined with short spacings. The vertical holes are used for both the linking and gasification processes. A sequential electrolinking process is performed by first forming an electrolink between A and B over a long distance (about 500 feet). Electrolinks are then formed between B and C and then C and D which are separated by about 250 feet each. The linking steps are designed to minimize wander of the new link to the center section of previously established links. The link is finally extended from D to I in a series of 100-foot steps to provide control over electrolink wandering and to retain 100-foot control over the gasification process. These links can also be established with directional drilling or counter-current combustion.

The gasification process is initiated by igniting the coal and injecting combustion-supporting gas at first injection hole B to produce product gases which are removed at production hole A. Region 12 around the A–B link shows the region of coal removal at the time the product gas heating value starts to fall off. At this time the injection point is moved to C while A remains the production well and the region 14 illustrates the region of coal removal while C is the injection point. The injection point is then moved sequentially from D to I with regions 16, 18, 20 and additional similar regions around each of the remaining injection wells showing the coal removal areas with each step. The process thereby sweeps out the total area of the coal seam enclosed within the vertical holes. The primary coal removal occurs when the injection point is moved from D to I during which the gasification zone extends across the full area.

As the channel widens, the area of coal removal becomes too large for an open channel to remain. The overburden thus bends into the void. As the B–D channel widens and moves towards the A–I ends of the U, a self-sustaining arch cannot remain across the area of coal removal and bending subsidence begins. If bending subsidence prevails, the subsidence forms a zone of compressed, relatively low permeability material at a small distance to the right of the coal face and a zone adjacent to the coal face with relatively high permeability. This set of conditions confines gas flow to a region close to the unconsumed coal face. This zone of compression moves to the left, in FIG. 1, with the coal face as coal is gasified. The relatively close spacing of the injection holes from D to I helps to maintain spatial control of the process while the subsidence effect limits the width of the channel and confines gas flow near the coal face. The injection must be controllable so that the injected gases are introduced between the compression zone and the coal face. Coarse gravel may be injected into each injection hole as the coal immediately below it is consumed, thus locally propping open the hole. The causation and use of subsidence controlled by the sweeping geometry confines the gas flow and permits the gasification of the thin coal seam.

Figure 2:
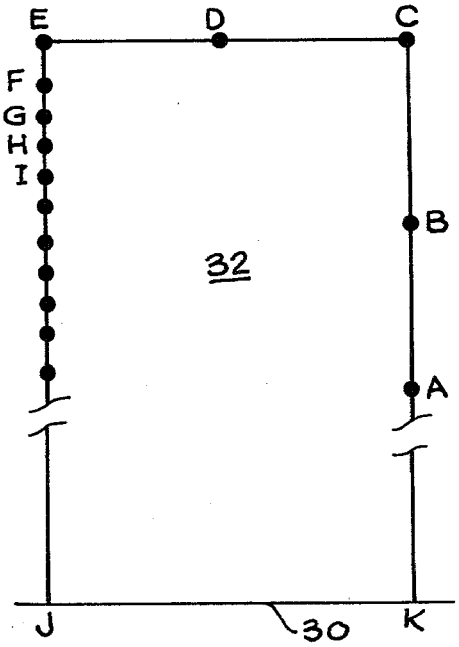
FIG. 2 is a top plan view of a coal seam extending from an exposed coal face of an abandoned strip mine and the linkage of vertical access holes around the coal removal area.

Another embodiment of the invention, shown in FIG. 2, is directed at the gasification of coal remaining at abandoned strip mines in which relatively thin coal seams were surface mined into a hillside or down a gradual slope until the overburden became too thick for further mining. If the mine has not been backfilled the coal face remains exposed. The linkage paths K–C and J–E are established by drilling in from the coal face 30 for distances up to 3,000–4,000 feet. These straight, horizontal holes can be drilled into the coal seam by conventional and relatively inexpensive drilling methods. A series of vertical access holes A through I etc. are drilled around the perimeter of the coal removal area 32 into the linkage paths. The link from C to E is established by one of the known methods. The gasification process is carried out as previously described by sweeping out the coal removal area by sequentially moving the injection point around the perimeter away from the production well and using the controlled bending subsidence to channel the gas. The relatively close spacing of the injection holes from E to I and additional holes along the J–E linkage path of about 100 feet are to provide spatial control of the process while the distances between the other holes A–B, B–C, and C–E can be much larger (around 500 feet). During the gasification process a 300-foot wall of coal near the coal face is retained to maintain gas integrity for the process and can be removed later by augering.

Figure 3:
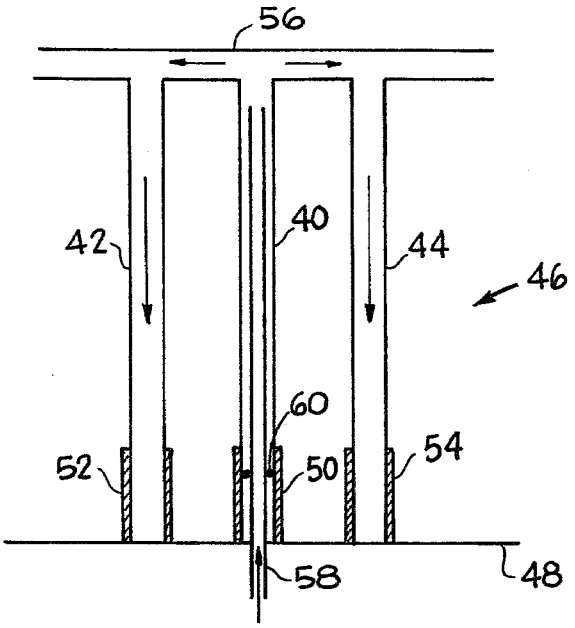
FIG. 3 is a top sectional view through a coal seam of injection and recovery wells drilled into the seam from an exposed coal face at an abandoned strip mine with a link at the back of the coal removal area and with gas injection and production taking place entirely at the coal face.
Figure 4:
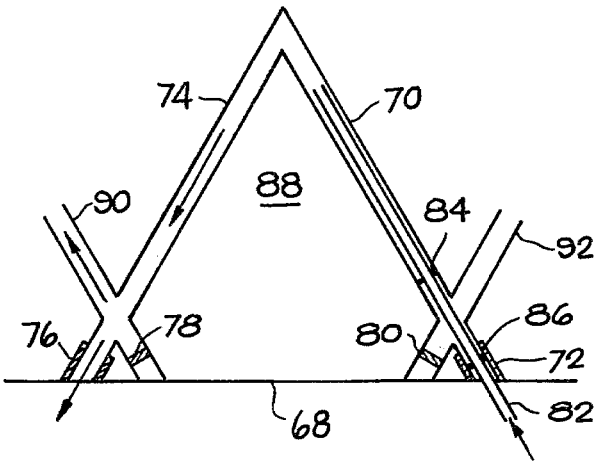
FIG. 4 is a top sectional view through a coal seam of the injection and production holes extending into the seam entirely from the exposed coal face in an abandoned strip mine.

Alternate embodiments of the invention, shown in FIGS. 3 and 4, are implemented entirely or almost entirely from the coal face. These methods are useful in areas where the terrain over the coal is inaccessible but a coal face is exposed. As shown in FIG. 3, injection hole 40 and recovery holes 42 and 44 are drilled into coal removal area 46 from an exposed coal face 48. The access holes are encased by casings 50, 52 and 54, respectively. The access holes extend into the coal removal area for a distance of about 1,000 feet and are linked at the back by link 56 to form a U-shaped coal removal area. The link 56 can be established either through the overburden or by directionally drilling a curved hole in from the coal face. Spacing between the injection well and production well is about 100 feet. The injection point is controlled by a long pipe 58 which is mounted in casing 50 of injection well 40 by packing gland 60. The pipe 58 is either withdrawn or degrades so the injection point is gradually moved toward the coal face 48 as the coal is gasified. By starting the gasification process by injection near the back of the coal removal area and sweeping forward as the injection point is gradually moved forward controlled bending subsidence occurs. Accordingly, the gas injection point is maintained inside the compression zone created by subsidence thereby confining gas flow to a region close to the unconsumed coal.

The embodiment shown in FIG. 4 is similar to that shown in FIG. 3 except that no link is required at the back of the coal removal area. The method is performed solely through coal face 68. Injection hole 70 extends into the coal seam through casing 72 at an angle to the coal face 68 and recovery hole 74 extends through casing 76 into the coal seam at an angle to coal face 68 joining access hole 70 to encompass a triangular coal removal area 88. Additional access holes 90 and 92 may be drilled into the coal face to extend the coal removal area. These are blocked by plugs 78 and 80. A long, withdrawable or degradable pipe 82 extends into injection hole 70 and is supported by packing glands 84 and 86. The injection point is moved from the back toward the coal face in order to sweep out the coal removal area and cause controlled bending subsidence to channel the gas close to the unconsumed coal.

Changes and modifications in the specifically described embodiments can be carried out without departing from the scope of the invention, which is intended to be limited only by the scope of the appended claims.

I claim:

1. A method for underground gasification of coal in a coal removal area in a deep, thin, substantially horizontal coal seam comprising:

injecting combustion supporting gas at an injection point into the coal seam and igniting the coal to produce product gases;

causing and controlling bending subsidence of overburden to sweep across the coal removal area adjacent to unprocessed coal by combustion of the coal by sequentially moving the injection point for the combustion supporting gas around the coal removal area away from a recovery well to confine gas flow to a region close to unprocessed coal between the unprocessed coal and the subsided overburden; and removing the product gases.

2. The method of claim 1 wherein the sequential moving of the injection point is performed by:

drilling a plurality of vertical holes through the overburden into the coal seam around the perimeter of the coal removal area, the vertical holes including a production hole and a plurality of injection holes;

sequentially linking the vertical holes through the coal seam; and sequentially injecting combustion supporting gas into the injection holes, starting at the injection hole adjacent to the production hole and proceeding sequentially away from the production hole, and removing product gas from the production hole, thereby sweeping out the coal removal area and causing controlled bending subsidence of the overburden to confine the combustion supporting gas to a region close to unprocessed coal.

3. The method of claim 1 for gasification of a coal seam extending into a thick overburden from an exposed coal face, at an abandoned strip mine, wherein the sequential moving of the injection point is performed by:

drilling a pair of parallel holes horizontally into the coal seam from the exposed coal face, along two sides of the coal removal area;

drilling a plurality of vertical holes through the overburden into the coal seam around the perimeter of the coal removal area and into the horizontal holes;

linking the horizontal holes at the ends opposite the exposed coal face, enclosing the coal removal area; and sequentially injecting combustion supporting gas into the injection holes, starting at the injection hole adjacent to the production hole and proceeding sequentially away from the production hole, and removing product gas from the production hole, thereby sweeping out the coal removal area and causing controlled bending subsidence of the overburden to confine the combustion supporting gas to a region close to unprocessed coal.

4. The method of claim 1 for gasification of a coal seam extending into a thick overburden from an exposed coal face, at an abandoned strip mine, wherein the sequential moving of the injection point is performed by:

drilling a plurality of access holes horizontally into the coal seam from the exposed coal face, including an injection hole and at least one recovery hole; and injecting combustion supporting gas into the injection hole at an injection point which is gradually moved toward the exposed coal face from an initial point near the perimeter of the coal removal area opposite the exposed coal face, thereby sweeping out the coal removal area between the injection hole and recovery holes and causing controlled bending subsidence of the overburden to confine the combustion supporting gas to a region close to unprocessed coal.

5. The method of claim 4 wherein the horizontal access holes are substantially parallel and linked together at the perimeter of the coal removal area opposite the exposed coal face.

6. The method of claim 4 wherein the horizontal access holes are at angles to the exposed coal face, intersecting and joining to form a link and defining a triangular coal removal area therebetween.

7. The method of claims 4, 5 or 6 wherein the injection point is gradually moved by gradually withdrawing a withdrawable injection pipe inserted into the injection hole.

8. The method of claims 4, 5, or 6 wherein the injection point is gradually moved by the gradual degradation of a degradable injection pipe inserted into the injection hole.

* * * * *